US011192390B2

(12) United States Patent
Noll et al.

(10) Patent No.: US 11,192,390 B2
(45) Date of Patent: Dec. 7, 2021

(54) METHOD FOR PRINTING A CYLINDRICAL PRINTING SURFACE OF A BEVERAGE CAN, AND PRINTED BEVERAGE CAN

(71) Applicant: BALL EUROPE GMBH, Zurich (CH)

(72) Inventors: Werner Noll, Huebingen (DE); Jurgen Krupp, Cologne (DE)

(73) Assignee: BALL BEVERAGE PACKAGING EUROPE LIMITED, Bedfordshire (GB)

( * ) Notice: Subject to any disclaimer, the term of this patent is extended or adjusted under 35 U.S.C. 154(b) by 0 days.

(21) Appl. No.: 14/405,903

(22) PCT Filed: May 28, 2013

(86) PCT No.: PCT/EP2013/060979
§ 371 (c)(1),
(2) Date: Dec. 5, 2014

(87) PCT Pub. No.: WO2013/182454
PCT Pub. Date: Dec. 12, 2013

(65) Prior Publication Data

US 2015/0174917 A1 Jun. 25, 2015

(30) Foreign Application Priority Data

Jun. 8, 2012 (DE) ..... 102012209675.2

(51) Int. Cl.
*B41J 3/54* (2006.01)
*B41J 3/407* (2006.01)
(Continued)

(52) U.S. Cl.
CPC ..... *B41J 3/546* (2013.01); *B41F 17/22* (2013.01); *B41F 19/007* (2013.01);
(Continued)

(58) Field of Classification Search
CPC ..... B41F 19/007
See application file for complete search history.

(56) References Cited

U.S. PATENT DOCUMENTS 3,788,497 A * 1/1974 Carlson ..... B65G 47/5181 198/432
3,811,306 A * 5/1974 Yoshimura ..... B21D 51/2615 72/126
(Continued)

FOREIGN PATENT DOCUMENTS

CN 1167068 12/1997
CN 1186464 7/1998
(Continued)

OTHER PUBLICATIONS

Thomson Gale, "Aluminum Beverage Can", http://www.madehow.com/Volume-2/Aluminum-Beverage-Can.html, retrieved using Internet Wayback Machine date Mar. 26, 2006.*
(Continued)

*Primary Examiner* — David M. Gray
*Assistant Examiner* — Quang X Nguyen
(74) *Attorney, Agent, or Firm* — Sheridan Ross P.C.

(57) ABSTRACT

The invention relates to a method for printing a cylindrical printing surface of a beverage can with a printing image, and to a beverage can. The method comprises a first and a second printing operation, in the first printing operation, a first section of the printing surface being printed by way of a first printing process in a first printing press, in the second printing operation, a second section of the printing surface being printed by way of a second printing process which is preferably different from the first printing process in a second printing press, the beverage can being positioned before or during the second printing operation in such a way that the second section of the printing surface is oriented in a predefined position with respect to the first section of the
(Continued)

printing surface. The beverage can is printed by way of this method, the first section and the second section of the printing surface being arranged in a predefined position with respect to one another.

22 Claims, 4 Drawing Sheets

(51) Int. Cl.
*B65D 25/34* (2006.01)
*B41F 19/00* (2006.01)
*B41F 17/22* (2006.01)

(52) U.S. Cl.
CPC ..... *B41J 3/4073* (2013.01); *B41J 3/40733* (2020.08); *B65D 25/34* (2013.01)

(56) References Cited

U.S. PATENT DOCUMENTS

| | | | | |
|---|---|---|---|---|
| 3,952,698 | A * | 4/1976 | Beyer | B65D 25/34 118/314 |
| 5,010,814 | A | 4/1991 | Shishikura | |
| 5,543,186 | A * | 8/1996 | Andersen | B05B 11/0037 106/400 |
| 6,472,034 | B1 * | 10/2002 | Bourdelais | B65D 23/085 428/35.7 |
| 6,769,357 | B1 | 8/2004 | Finan | |
| 7,905,174 | B2 | 3/2011 | Vetter et al. | |
| 2010/0229737 | A1 | 9/2010 | Ouchi | |
| 2011/0067584 | A1 * | 3/2011 | Mueller | B41F 15/0872 101/35 |
| 2012/0025516 | A1 * | 2/2012 | Miller | A63F 3/0655 283/100 |
| 2013/0068352 | A1 * | 3/2013 | Siles | C22C 21/00 148/552 |

FOREIGN PATENT DOCUMENTS

| | | | | |
|---|---|---|---|---|
| CN | 1720140 | | 1/2006 | |
| CN | 101537904 | | 9/2009 | |
| CN | 101708673 | | 5/2010 | |
| CN | 101808825 | | 8/2010 | |
| CN | 201677576 | | 12/2010 | |
| CN | 102143846 | | 8/2011 | |
| CN | 103492272 | | 1/2014 | |
| DE | 10226500 | | 1/2004 | |
| DE | 10 2009 033810 | A1 | 1/2011 | |
| EP | 2100733 | | 7/2010 | |
| EP | 2631191 | | 8/2013 | |
| EP | 2703305 | | 3/2014 | |
| JP | S57-34186 | | 7/1982 | |
| JP | S63-158155 | | 7/1988 | |
| JP | H08-72883 | | 3/1996 | |
| JP | 2004-66753 | | 3/2004 | |
| JP | 2010-018390 | | 1/2010 | |
| JP | 2010-168114 | | 8/2010 | |
| JP | 2012-086870 | | 5/2012 | |
| JP | 2012086870 | A * | 5/2012 | B41M 1/04 |
| WO | WO 2004/109581 | | 12/2004 | |
| WO | WO 2009/112160 | A1 | 9/2009 | |
| WO | WO 2012/053406 | | 4/2012 | |

OTHER PUBLICATIONS

Hartman (Canning olives the Musco Way, PackagingDigest.com), published Jan. 31, 2002.*
US Environmental Protection Agency, Preliminary Industry Characterization: Metal Can Manufacturing—Surface Coating, Sep. 1998 (Year: 1998).*
English Translation of China Patent Application No. 2013800414138,dated Aug. 6, 2015, 12 pages.
International Search Report and Written Opinion prepared by the European Patent Office dated Aug. 27, 2013, for International Application No. PCT/EP2013/060979.
Machine Translation of Official Action for Japan Patent Application No. 2015-515474, dated Dec. 20, 2016.
Decision to Grant with Machine Translation for Japan Patent Application No. 2015-515474, dated Oct. 10, 2017 5 pages.
"Product list: Showa aluminum can," Showa Aluminum Can Corp., dated Jun. 4, 2018, 4 pages [retrieved online from www.showacan.co.jp/products].
"UJF-3042FX brochure," Mimaki Electric Corporation, Oct. 1, 2011, 2 pages.
Notice of Opposition for Japan Patent No. 6242880, dated Jul. 4, 2018.
Official Action with machine translation for Mexico Patent Application No. MX/a/2014/014795, dated Aug. 31, 2017.
Official Action for Canada Patent Application No. 2,875,741, dated Mar. 26, 2019 4 pages.
Official Action with machine translation for European Patent Application No. 13725383.7, dated Oct. 5, 2018 6 pages.
Notification of Reasons for Revocation with English translation for Japan Patent No. 6242880, dated Jan. 9, 2019 87 pages.
Official Action for Mexico Patent Application No. MX/a/2014/014795, dated Apr. 25, 2018 6 pages.
Official Action with machine translation for European Patent Application No. 13725383.7, dated Aug. 2, 2019 6 pages.
Official Action with machine translation for Mexico Patent Application No. MX/a/2014/014795, dated Apr. 30, 2019 10 pages.
Official Action with Informal English Translation for Brazil Patent Application No. BR112014030141-7, dated Feb. 11, 2020 5 pages.
Notice of Allowance for Canada Patent Application No. 2,875,741, dated Feb. 19, 2020 1 page.
Intention to Grant for European Patent Application No. 13725383.7, dated Apr. 28, 2020 5 pages.
Official Action with Machine Translation for Mexico Patent Application No. MX/a/2014/014795, dated Jan. 21, 2020 5 pages.
Notice of Allowance with Machine Translation for Mexico Patent Application No. MX/a/2014/014795, dated Sep. 4, 2020 4 pages.
Official Action with English Translation for Brazil Patent Application No. BR112014030141-7, dated Feb. 21, 2021 6 pages.

* cited by examiner

METHOD FOR PRINTING A CYLINDRICAL PRINTING SURFACE OF A BEVERAGE CAN, AND PRINTED BEVERAGE CAN

CROSS REFERENCE TO RELATED APPLICATIONS

This application is a national stage application under 35 U.S.C. 371 and claims the benefit of PCT Application No. PCT/EP2013/060979 having an international filing date of May 28, 2013, which designated the United States, which PCT application claimed the benefit of German Application No. 10 2012 209 675.2 filed Jun. 8, 2012, the disclosures of each of which incorporated herein by reference.

FIELD

The invention relates to a method for printing a cylindrical printing surface of a beverage can, in particular made from tin or aluminum, with a printing image.

Furthermore, the invention relates to a beverage can, in particular made from tin or aluminum, having a cylindrical printing surface with a printing image.

BACKGROUND

The area of application of the invention relates to the printing of beverage cans. Here, a beverage can is understood to mean a beverage can body with a bottom, a cylindrical shell and an open end which lies opposite the bottom. Beverage cans of this type are usually arranged in pallets and delivered to bottling companies which fill the beverage cans with a beverage through the open end and, after filling, close the open end with a beverage can lid, with the result that there is then a filled, closed beverage container. The open end of the beverage can is preferably drawn in and provided with an outwardly bent flange edge, with the result that a beverage can lid can be connected by way of a flange connection to the outwardly bent flange edge of the open end of the beverage can. Beverage cans are preferably manufactured from tin or steel or aluminum.

The printing of a beverage can usually belongs to the overall manufacturing process of a beverage can. In addition to printing, the overall manufacturing process of a beverage can usually comprises cutting out of a blank and deep drawing of a bowl which is subsequently elongated to form a can body, cutting or trimming of the open end, washing of the beverage cans, in order to remove excess elongation agent, application of various coatings, such as UV coatings and internal, external and bottom varnishes, drying (possibly multiple times) after one or more process steps, drawing in of the open end and inspection, for example in order to test for holes and flange cracks, and palletizing.

A printing image which has a graphic design which is intended to appeal to a user is preferably applied to the outer surface of the cylindrical shell of a beverage can, that is to say to a cylindrical printing surface. As an alternative or in addition, graphic elements with an informative character can be arranged in the printing image, for example information about contents, deposit marks, best before or production dates, identification numbers or the like.

A printing image of this type is usually applied by way of a printing operation to the cylindrical printing surface of a beverage can. It is known, for example, to print beverage cans using the relief printing process. Furthermore, it is known, for example, from WO 2004/109581 A2 to digitally print beverage cans. EP 2 100 733 B1 has disclosed a printing press for printing hollow bodies, in which a plurality of printing presses are provided which can print the hollow bodies by way of different printing processes.

Whereas satisfactory results with regard to the depiction with defined company-specific colors can already be achieved by way of existing printing processes, the requirements are increasing, however, for example with regard to the ability to depict color combinations, and with regard to the level of resolution. However, these requirements either cannot be met at all by way of existing printing processes, or can be met only in conjunction with high costs. Furthermore, the production of small runs of a defined printing image is associated with high costs, since a small run usually comprises only approximately between 3000 and 100,000 copies.

SUMMARY

It is therefore an object of the present invention to provide a method for printing a cylindrical printing surface of a beverage can, in particular made from tin or aluminum, with a printing image, which method avoids or reduces one or more of the stated disadvantages. In particular, it is an object of the present invention to provide a method for printing a cylindrical printing surface of a beverage can, in particular made from tin or aluminum, with a printing image, which method meets the requirements for customer-specific color designs and high resolution, and at the same time saves costs and increases the flexibility, for example for printing small runs.

According to the invention, this object is achieved by way of a method for printing a cylindrical printing surface of a beverage can, in particular made from tin or aluminum, with a printing image, comprising a first and a second printing operation, in the first printing operation, a first section of the printing surface being printed by way of a first printing process in a first printing press, in the second printing operation, a second section of the printing surface being printed by way of a second printing process which is preferably different from the first printing process in a second printing press, the beverage can being positioned before or during the second printing operation in such a way that the second section of the printing surface is oriented in a predetermined position with respect to the first section of the printing surface.

In the method according to the invention, beverage cans are printed in two different printing operations on two different printing presses, the two printing presses preferably using different printing processes. Here, the printing image to be produced is divided into at least two sections, of which one section is printed by way of one printing press and the other section is printed by way of the other printing press. Here, the one (first) printing press can carry out, for example, a printing process, by way of which relatively large print runs can be produced economically in high quality, whereas the other (second) printing process permits, for example, rapid changes of the printing image with relatively low outlay.

The cylindrical printing surface of the beverage can, onto which the printing image is applied, corresponds in the laid flat view to a rectangle, as is produced if the circumferential face of the beverage can is laid flat. The areas of the first and second section preferably together result in the area of this rectangle of the laid flat cylindrical printing surface. It is preferred, in particular, that the first and second section are arranged in such a way that a corresponding rectangular outer circumference is produced. The two sections of the printing surface preferably together result in the entire printing image, that is to say the two sections of the printing surface preferably complete one another. To this end, the first and second section are preferably arranged so as to adjoin one another, it being possible for them optionally to slightly overlap one another. It is therefore preferred that the second section has a recess which corresponds in terms of shape and size to the first section, with the result that, after the two printing operations, a printing image is produced which fills in the area of the cylindrical printing surface.

It is preferred, in particular, that the two sections adjoin one another without a spacing, in order to produce a common printing image without unprinted areas between the two sections. At the adjoining edges, one of the two sections can extend into an adjoining region of the other section. It can also be preferred that the printing images of both sections in each case extend into an adjoining region of the other section at their adjoining edges. Such overlapping of the printing images of the two sections in a transition region leads to improved meshing or integration of the printing images of the two sections and is therefore preferred, in particular, in the case of complex printing images. Furthermore, this overlapping can achieve a situation where the transition from one to the other section cannot be perceived or can be perceived only with difficulty by an observer.

It is provided according to the invention that a beverage can to be printed is fed to two different printing presses one after another and is subjected there to in each case one printing operation. Here, the first printing process is preferably a different one from the second printing process, that is to say the two printing processes which are used in the two printing presses preferably differ from one another.

Since the two printing operations take place on different printing presses, it is preferably provided that the beverage can which is printed by means of the first printing process in the first printing press is oriented before printing by means of the second printing process, in such a way that, after the second printing process, the first and second section of the printing surface are printed in such a way that a desired overall printing image is produced. This means that the beverage can is positioned exactly before or during the second printing operation, with the result that the printing of the second section in the second printing process takes place in such a way that the print in the second section fits the print in the first section with a high accuracy.

In every case, the printing image which is produced by way of the first printing press and the printing image which is produced by way of the second printing press are to be oriented precisely relative to one another. This can also take place by virtue of the fact that the second printing press is configured in such a way that it automatically detects image features of the printing image which is produced by the first printing press and performs or initiates relative positioning of the can (for example, by way of orientation of the can) in such a way that, as a result, the precise orientation of the two printing images or the two sections of the overall printing image is ensured.

The method according to the invention has the advantage that a division of the printing image into different sections of the printing surface can be performed, which sections can then be printed by way of different printing processes. In this way, an overall, preferably contiguous, printing image is produced which, however, can be produced by way of different printing processes. In this way, the respectively suitable printing processes can be used for different parts of the printing image which possibly have to satisfy different requirements, for example with regard to the coloration or resolution. Furthermore, it is possible to buffer-store the beverage cans between the first and second printing operation, in order, for example, to inexpensively produce the first sections which are printed by way of the first printing process in a large quantity and later to print smaller quantities by way of the second printing process, with the result that, for example, different series, editions, issues or collectables can be produced. Here, the printing image of the different (small) runs preferably differs only in the second section, with the result that the first printing operation can be carried out inexpensively in a large quantity.

A further advantage consists in the fact that, as a result of the separation of the two printing operations, transport of the beverage cans between the first and the second printing operation is also possible, for example also over a relatively great distance, if the two printing presses are arranged, for example, at different sites or at one site in different lines. A relatively great time delay between the first and second printing operation is also possible, with the result that, for example, the first sections can be printed in the first printing operation and a decision can be made only after a time delay as to how precisely the printing image is to be completed by way of the printing of the second section in the second printing operation. This is advantageous, in particular, when certain events are to be reacted to in a short time frame by way of an adaptation of the printing image.

Furthermore, it is possible to incorporate a multiplicity of different images or motifs into a greater run. For example, within one run which is distinguished by a uniform printing image in one of the two sections, a different printing image can be applied to the other of the two sections for each beverage can or groups of beverage cans, with the result that individualization of individual beverage cans or groups of beverage cans can take place. It is preferred, for example, that the individualized printing image has (image) elements which can preferably be read out via a mobile telephone or another mobile terminal and can possibly be processed further there or can be utilized for forwarding to other offers of information, for example by linking into the Internet. In particular, (image) elements are preferred which permit detection by means of what are known as "augmented reality" technologies. The individualized printing image can preferably have a code, for example a barcode or QR code, which can also preferably be read out via a mobile telephone or another mobile terminal and can possibly be further processed there or can be utilized for forwarding to other offers of information, for example by linking into the Internet. This individualization possibility has the advantage that individual "additional" information items can be provided per beverage can or group of beverage cans, which items go beyond the pure visual perception of the overall printing image by the consumer and make it possible to incorporate further media and communications means. Furthermore, small and very small runs as far as the individual beverage can can be designed in a manner which can be distinguished by the consumer and can preferably be linked with different additional information items which possibly build on one another and/or are connected to one another.

In the method according to the invention, a first printing operation for printing a first section of the printing surface in a first printing process and a second printing operation for printing a second section of the printing surface by way of a second printing process are provided. However, a third or further sections of the printing surface can likewise be printed in a third or further printing operations in a third or further printing presses by way of a third or further printing processes. The embodiment details and advantages described here for two sections also correspondingly apply to three or more sections and printing presses using corresponding printing processes.

It is particularly preferred that one of the two printing processes, preferably the first printing process, is a relief printing process. The use of a relief printing process is preferred, in particular, since high quantities can be printed inexpensively by way of this method and at the same time great variety in terms of the color design can be realized. For example, there are many colors or color combinations and color shades which are stipulated by the customer and cannot be realized or can be realized only with difficulty and/or with high costs by way of printing processes other than the relief printing process.

Furthermore, it is preferred that one of the two printing processes, preferably the second printing process, is a digital printing process, it preferably being possible for the second printing process to process beverage cans with different diameters, preferably between 40 and 90 mm, and/or with different heights, preferably between 40 and 250 mm.

The digital printing process has the advantage of particularly high resolution, for example of 600 dpi. Realistic, high-resolution images can be applied to beverage cans in this way. Furthermore, the digital printing process is suitable for printing different small runs at short notice on demand without great changeover times. It is particularly preferable that all the customary beverage can diameters, preferably between 40 and 90 mm, and beverage can heights, preferably between 40 and 250 mm, can be processed using the digital printing process.

In the combination, in particular, with printing of the first section using the relief printing process and the second section using the digital printing process, printing images can be produced in this way, in which firstly customer-specific color designs can be combined with secondly high-resolution image elements which can possibly be adapted at short notice on account of current events.

Furthermore, the combination of these processes is advantageous if certain compulsory constituent elements, for example information which is stipulated legally, by standardization or voluntary obligations, for instance by confederations, can be produced only using one of the two printing processes, such as the DPG deposit logo. This deposit mark is preferably printed using the relief printing process, with the result that the element of the deposit mark can be printed using the relief printing process in the case of printing images which are otherwise provided for digital printing.

A printing image which is applied to the second section of the printing surface is preferably oriented with an accuracy of ±50 micrometers (μm) relative to a printing image which is applied to the first section of the printing surface. This is preferred, in order to obtain an overall printing image which results from the printing images which are applied to the first and second section of the printing surface and has no offset or only a very small offset at the adjoining edges of the printing images. It is particularly preferred that a register mark is printed by way of the first printing process, which register mark is detected in the second printing press by a sensor, and the first printing image is put into register relative to the second printing image. This preferably takes place via the registration means of a receiving mandrel, on which a beverage can is held in a printing press.

With regard to the configuration of the sections, it is preferred that the first section is of rectangular configuration and the second section is of rectangular, square, circular or oval configuration, the first section having a recess which corresponds substantially to the first section. A free form of the second section can also be preferred depending on the desired printing image. It is particularly preferred that the second section is arranged in a corner of the first section, at an edge of the first section or in a central region of the first section.

The second section can be arranged within the first section, with the result that the first section forms a frame or edge around the outer circumference of the second section. In this case, the outer circumference of the printing image is formed by the first section. As an alternative, the second section can also be arranged at an edge or corner of the first section, with the result that the outer circumference of the printing image is formed partially by the first section and partially by the second section.

Here, a central region is to be understood to mean a middle region in the rectangle of the printing surface, that is to say a region which is at approximately identical spacings from the edges of the printing surface which lie opposite in each case.

These variants can also be of reversed configuration in relation to the sections, that is to say preferably the second section can be of rectangular configuration and the first section can be of rectangular, square, circular or oval configuration, the second section having a recess, which corresponds substantially to the first section. It is also preferred in this variant that the first section is arranged in a corner of the second section, at an edge of the second section or in a central region of the second section.

The selection of the configuration of the first and second section is dependent on the requirements of the printing images which are to be applied in the sections.

The first and second section of the printing surface can be substantially equally large. An equally large configuration of the first and second section can be brought about, for example, by virtue of the fact that the two sections are configured as two halves of the rectangle of the laid flat cylindrical printing surface. Both the size of the areas and their shape correspond to one another in this design.

In the case of a central arrangement of one of the sections in a central recess of the other section, the two sections are preferably configured in this embodiment in such a way that the sizes of the areas of both sections correspond to one another substantially, the shape of the two sections being different.

As an alternative, one section can be of larger configuration than the other section, for example the first section can be larger than the second section or the second section can be larger than the first section.

The ratio of the sections to one another is preferably selected from the following ratios: 50:50, 60:40, 70:30, 80:20, 90:10, 95:5, 97.5:2.5, 98:2, 98.5:1.5, 99:1, 99.5:0.5.

A further advantage results in one preferred embodiment by virtue of the fact that the beverage can is manufactured from aluminum or tin without a base coat or a clear lacquer, and the second section of the printing surface is printed by way of the first printing process in the first printing press with a uniform color, preferably with a white color.

In the case of beverage cans made from tin, the printing usually takes place on a white printing surface. In the case of aluminum cans, the unprinted printing surface usually has the color of the aluminum. In the case of the digital printing process, in particular, it is preferred, however, to print a white printing surface. The second section can therefore also preferably already be printed in the first printing process, to be precise preferably in a uniform color, for example with white. In this way, a white primed printing surface is then available in the second section for the second printing operation, which printing surface can then advantageously be printed using the digital printing process.

In one preferred embodiment of the method, the beverage can passes through further steps of a manufacturing process after the first printing operation and/or after the second printing operation. Furthermore, it is preferred that the beverage can is subsequently palletized, preferably with a plurality of further beverage cans. Pallets of this type of beverage cans which have passed through the first printing operation can be stored, for example, for a predefined time period or on demand. The further steps of the manufacturing process can be one or more of the steps mentioned at the outset.

In a further embodiment, a beverage can can be removed from a pallet before the second printing operation. This is preferred, in particular, when the beverage cans have been palletized after the first printing operation. Furthermore, it is preferred that the beverage cans are also palletized again after the second printing operation. The specification "after the second printing operation" means either directly after the second printing operation or after one or more further steps of a manufacturing process have been passed through after the second printing operation.

It is preferred, in particular, that the beverage can passes through a drawing-in operation before the second printing operation. As an alternative, the beverage can can also pass through a drawing-in operation only after the second printing operation. This is preferred, in particular, if the first or second printing press can print only beverage cans without a drawn-in open end.

A further aspect of the invention is a beverage can, in particular made from tin or aluminum, having a cylindrical printing surface with a printing image, a first section of the printing surface being printed in a first printing operation by way of a first printing process in a first printing press, a second section of the printing surface being printed in a second printing operation by way of a second printing process in a second printing press, the first section and a second section of the printing surface being arranged in a predefined position with respect to one another.

Reference is made to the preceding description with respect to the corresponding method features in respect of the advantages, design variants and design details of this further aspect of the invention and its developments.

BRIEF DESCRIPTION OF THE DRAWINGS

Preferred embodiments of the invention will be described by way of example using the appended figures, in which.

DETAILED DESCRIPTION

Figure 1:
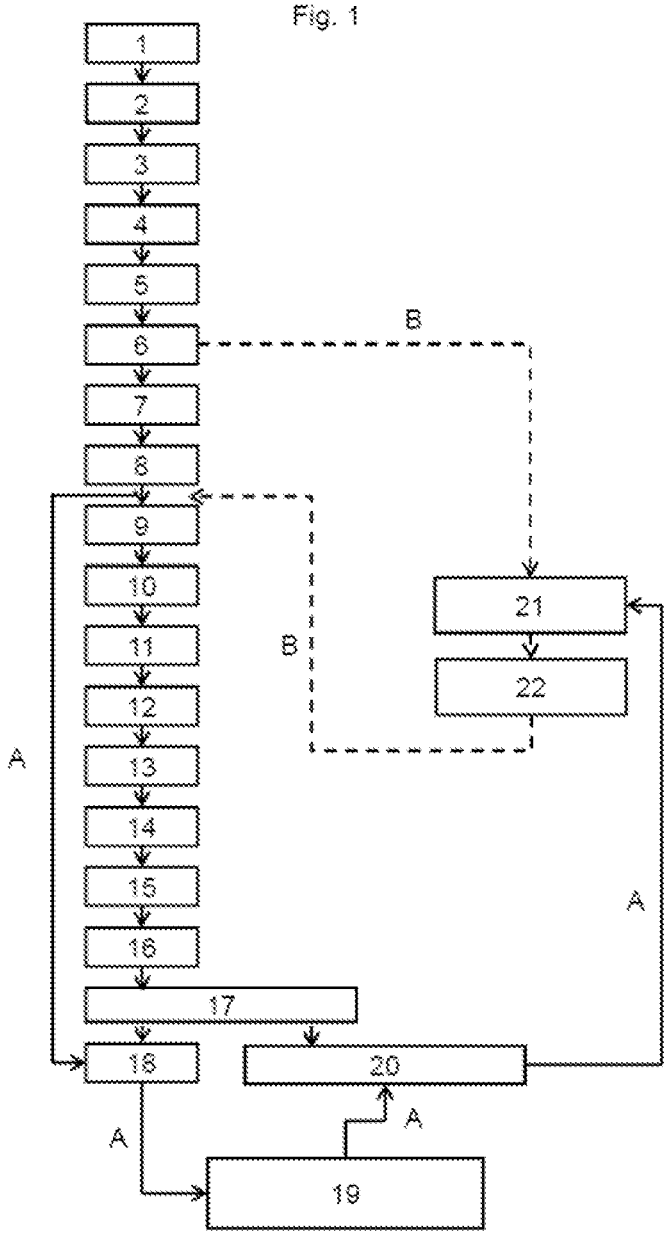
FIG. 1 shows a diagrammatic flow diagram of a manufacturing process for beverage cans with a first embodiment of a method according to the invention.

FIG. 1 shows a process for manufacturing beverage cans in steps 1 to 19. In step 1, a blank is punched out and is deep-drawn to form a bowl which is elongated in step 2 and the open end of which is cut or trimmed in step 3. In step 4, excess elongation agent is washed off from the beverage cans and the cans are dried in an oven, before they are provided with a first outer coat (step 5), for example with a white coat. Subsequently, the beverage cans are fed to an oven for drying in step 6. In a printing press, the beverage cans are then printed using the relief printing process in step 7 and are subsequently dried in an oven in step 8. After a first inner coat by means of a paint spraying machine in step 9 and subsequent drying in an oven in step 10, the open ends of the beverage cans are drawn in in step 11 and are provided with a flange edge before the bottoms of the beverage cans are painted in a bottom painting machine in step 12. The bottom painting is required, in particular, in the case of beverage cans made from tin.

After a second inner coat, in particular in the case of beverage cans made from tin, in a paint spraying machine in step 13, the beverage cans are again dried in an oven in step 14 before they are inspected in step 15 and are provided in step 16 with a further bottom coating, for example a UV coating. In step 17, sorting of the beverage cans can take place using defined sorting markings before the beverage cans are palletized in step 18, possibly according to item type, and are fed to a store in step 19.

After an undefined or predefined storage time or storage time on demand, the beverage cans can be removed from the pallet again in step 20 and can be printed digitally in a step 21 and can subsequently be dried in an oven in step 22. The performance only of steps 1 to 19 corresponds to the standard relief printing process, if the entire printing image is printed using the relief printing process in step 7. The performance of steps 1 to 6, 21, 22 and 9 to 19 according to the arrows B corresponds to the conventional process of complete digital printing, that is to say production of the entire printing image using the digital printing process.

The performance of the steps 1 to 8, 18 to 22 and subsequently steps 9 to 20 according to the arrows A corresponds to one embodiment of the method according to the invention, in which, in step 7, only a first section of the printing image is printed using the relief printing process in a first printing press by means of a first printing process. After drying in step 8, the partially printed beverage cans are guided past the processing steps 9 to 17 in a bypass and are integrated again into the manufacturing process in step 18. After palletization in step 18 and storage in the palletized state in step 19, the beverage cans are subsequently removed from the pallets in step 20, are fed to a digital printing press for printing the second section using the digital printing process in step 21 and, after drying in step 22, are fed again to the usual manufacturing process after step 8 and are mixed with the beverage cans which are printed using the relief printing process. These beverage cans which are then also printed in the second printing operation then pass through steps 9 to 16 which have not been passed through before from inner coating to UV bottom coating. After decorative pattern detection and corresponding separation in step 17, the beverage cans are palletized in each case separately. In step 17, the digitally printed beverage cans are preferably separated from the beverage cans printed using the relief printing process and are palletized in step 20. The beverage cans printed using the relief printing process run further onto the line palletizer and are palletized there in step 18.

This method according to FIG. 1 has the advantage of realizing both a pure relief printing process, a pure digital printing process and an embodiment of a method according to the invention with a combination of relief printing and digital printing. Furthermore, merely a digital printing station for step 21 and an oven for step 22, and possibly a pallet removing device for step 20, are to be provided additionally in an existing plant for producing beverage cans. In this way, an existing plant for producing beverage cans can be retrofitted simply for carrying out a method according to the invention.

Figure 2:
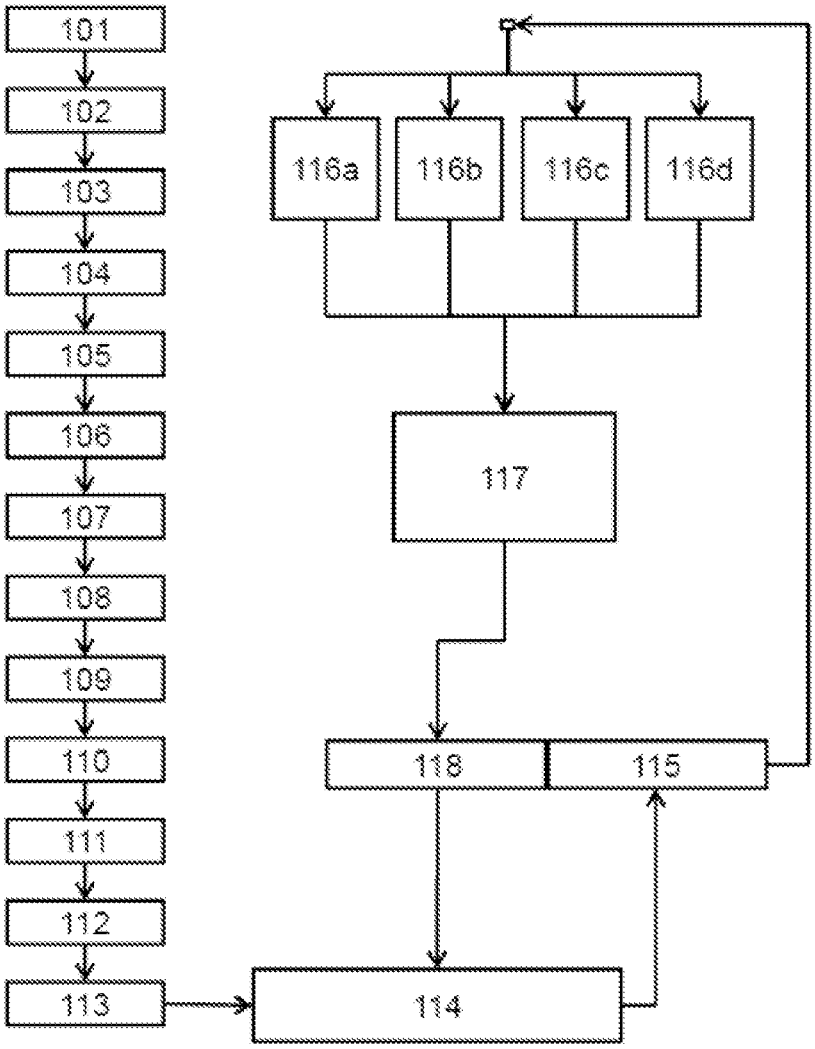
FIG. 2 shows a diagrammatic flow diagram of a manufacturing process for beverage cans with a second embodiment of a method according to the invention.

FIG. 2 likewise shows in steps 101 to 114 a customary manufacturing process of a beverage can with punching out of a blank and deep drawing of a bowl in step 101, elongation in step 102 and subsequent trimming of the open end in step 103. After excess elongation agent has been washed off in step 104, the beverage cans are dried in step 105 and are subsequently provided with a UV coating in step 106, before printing using the relief printing process takes place in step 107 with subsequent drying in step 108. A coat is subsequently applied in step 109 by way of a paint spraying machine, which coat is subsequently dried in step 110. In step 111, the open end of the beverage cans is drawn in and is provided with a flange edge. After the inspection of the beverage cans in step 112, they are palletized in a palletizing device in step 113 and are subsequently stored according to step 114. After an undefined or predefined storage time or storage on demand, the beverage cans are removed from the pallets and are fed to one or more parallel digital printing presses. In the exemplary embodiment which is shown in FIG. 2, four digital printing presses are provided, with the result that beverage cans can be printed digitally in parallel in steps 116*a, b, c, d*. The beverage cans are subsequently dried together in step 117 and are palletized again in step 118. The provision of a plurality of digital printing presses in step 116*a, b, c, d* has the advantage that a higher throughput can be achieved, for example 200 million beverage cans annually.

The variant which is shown in FIG. 2 has the advantage that the beverage cans do not once again have to be inserted into the manufacturing process after the second printing operation, but rather the second printing operation can take place independently of the first printing operation and further steps of the manufacturing process. The second printing operation can therefore also advantageously take place independently of the material of the beverage can, that is to say tin or aluminum. Furthermore, different can diameters, different can heights and beverage cans which are already drawn in at the open end can preferably be printed digitally in the second printing operation.

Moreover, the fundamental advantages of the method according to the invention with the division of the printing of the first and second section by way of first and second printing presses can also be realized with the exemplary embodiment which is shown in FIG. 2.

FIGS. 3 to 6 show examples for printing images which are composed from two sections. The printing images are shown as rectangles of the laid flat cylindrical printing surface. In the examples, the areas of the two sections together in each case form the rectangle of the laid flat cylindrical printing surface, that is to say printing images which fill the rectangle of the laid flat cylindrical printing surface are produced overall.

Figure 3:
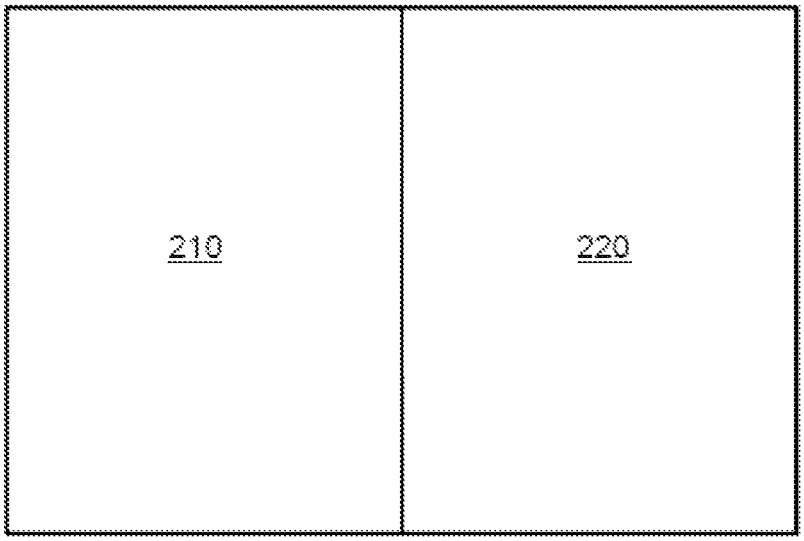
FIG. 3 shows a first example for a printing image which is composed from two sections.
Figure 4:
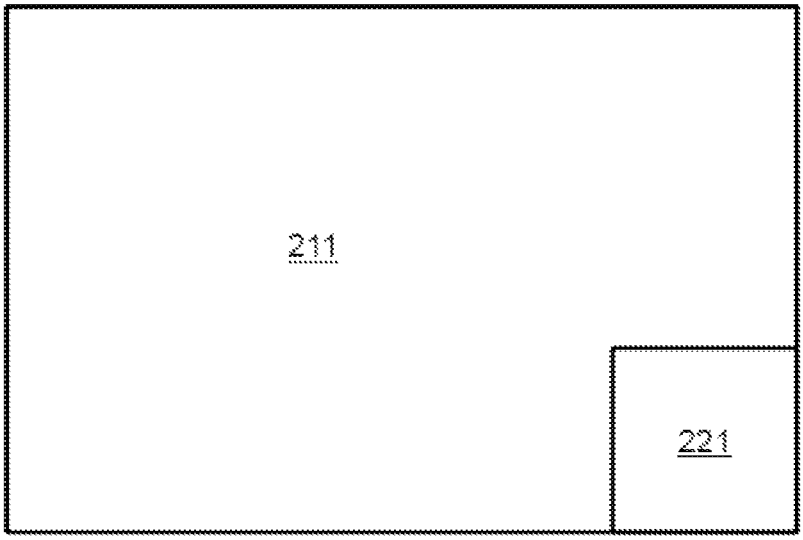
FIG. 4 shows a second example for a printing image which is composed from two sections.
Figure 5:
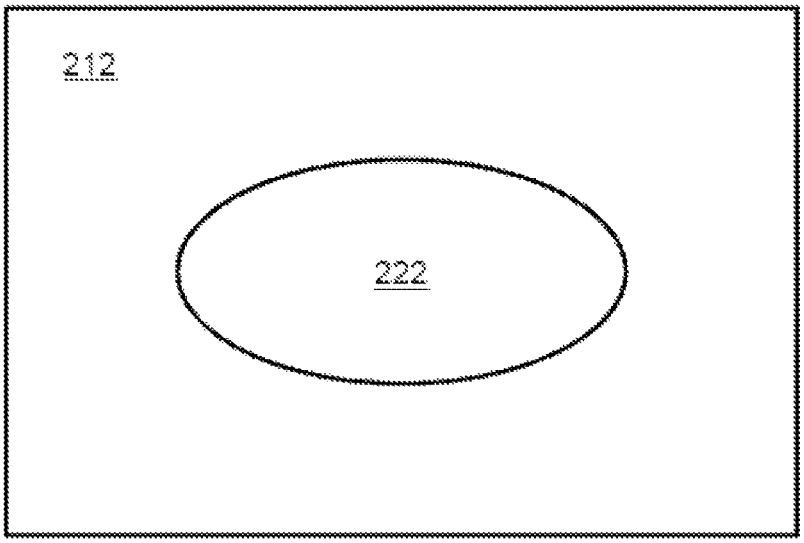
FIG. 5 shows a third example for a printing image which is composed from two sections.
Figure 6:
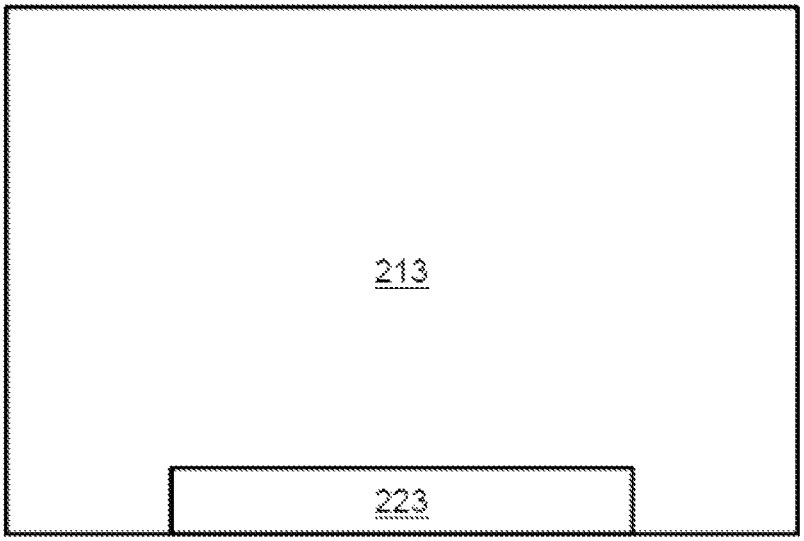
FIG. 6 shows a fourth example for a printing image which is composed from two sections.

In FIG. 3, the first section 210 and the second section 220 are equally large and form two halves of the rectangle of the laid flat cylindrical printing surface. In FIG. 4, the second section 221 is of square configuration and is arranged in a correspondingly square recess in a corner of the first section 211. FIG. 5 shows the configuration of the second section 222 as an oval which is arranged in a corresponding recess in a central region of the first section 212. In FIG. 6, the second section 223 is of rectangular configuration and is arranged in a corresponding recess at the lower edge of the first section 213.

The illustrations of FIGS. 3 to 6 can also be realized with a reversed configuration of the sections, that is to say the shapes of the second sections which are shown can also be formed by the first sections and vice versa.

Furthermore, in each case one configuration, in which the two sections adjoin one another without overlapping, is shown in the examples of FIGS. 3 to 6 which are shown. It can be preferred, however, that the printing image of one section protrudes into an adjoining overlapping region of the other section. It is particularly preferred, in particular in the case of complex printing images, that both sections protrude in each case into an adjoining overlapping region of the respectively other section.

The invention claimed is:

1. A method for printing an image on a cylindrical outer surface of a plurality of metallic containers in two distinct operations on independent equipment, comprising:

printing, in a first printing operation, a first section of the cylindrical outer surface of each of the plurality of metallic containers with a first portion of the image by a relief printing process in a first printing press at a first site;

printing, by the relief printing process in the first printing press during the first printing operation, a distinct second section of the cylindrical outer surface of each of the plurality of metallic containers with a uniform color, wherein the first and second sections adjoin one another without overlapping;

removing the plurality of metallic containers from the first printing press;

applying an internal coating to the plurality of metallic containers at the first site after the first printing operation and before palletizing the plurality of metallic containers;

forming a flange adapted to receive an end closure by drawing in an open end of each of the plurality of metallic containers, wherein the flange is formed at the first site after the first printing operation;

palletizing the plurality of flanged metallic containers;

transporting a pallet including the plurality of flanged metallic containers from the first site to a second site that is different than the first site;

removing the plurality of flanged metallic containers from the pallet at the second site;

loading the plurality of flanged metallic containers into a second printing press at the second site;

detecting a position of the first portion of the image on each of the plurality of flanged metallic containers;

orienting each of the plurality of flanged metallic containers with respect to the second printing press in such a way that a second portion of the image to be applied to the distinct second section of the cylindrical outer surface is oriented relative to the first portion of the image in the first section of the cylindrical outer surface; and printing, in a second printing operation, the distinct second section of the cylindrical outer surface with the second portion of the image by a digital printing process in the second printing press, wherein the second printing press is independent of the first printing press and located at the second site.

2. The method of claim 1, wherein each of the plurality of metallic containers is manufactured from aluminum or tin, and wherein the digital printing process is operable to process metallic containers with diameters of between 40 and 90 mm, and heights of between 40 and 250 mm.

3. The method of claim 1, wherein the second portion of the image which is applied to the distinct second section of the cylindrical outer surface is oriented with an accuracy of approximately 50 micrometers relative to the first portion of the image which is applied to the first section of the cylindrical outer surface, and wherein the second printing press prints the second portion of the image at about 600 DPI.

4. The method of claim 1, wherein the first section is of rectangular configuration and the distinct second section is arranged at least partially within the first section and is of rectangular, square, circular or oval configuration, the first section having a recess which corresponds substantially to the second section.

5. The method of claim 1, wherein loading the plurality of flanged metallic containers into the second printing press includes positioning the flanged metallic containers on mandrels of the second printing press, and wherein the second printing press prints flanged metallic containers with drawn in open ends.

6. The method of claim 1, further comprising:

printing a register mark by the first printing press; and detecting the register mark by a sensor of the second printing press.

7. The method of claim 1, wherein the second printing operation takes place independently of the first printing operation.

8. The method of claim 1, wherein the first and second sections have sizes that are either substantially the same or one section is larger than the other section, the smaller section being up to 10% of the larger section.

9. The method of claim 1, wherein the internal coating is applied to the plurality of metallic containers before the flange is formed on the plurality of metallic containers.

10. The method of claim 1, wherein the internal coating is applied to the plurality of metallic containers by a spraying machine.

11. The method of claim 1, further comprising:

drying each of the plurality of metallic containers in an oven after the first printing operation and before applying the internal coating; and drying the internal coating in an oven before the flange is formed on the plurality of metallic containers.

12. The method of claim 11, further comprising palletizing the plurality of flanged metallic containers with the first and second image portions.

13. The method of claim 1, wherein the uniform color printed by the first printing press in the distinct second section is white.

14. The method of claim 1, wherein the metallic containers are two-piece metallic containers formed by a draw-and-ironing process.

15. The method of claim 1, wherein the second section has an area that is less than approximately 30% of an area of the cylindrical outer surface of each of the plurality of metallic containers.

16. The method of claim 1, wherein the metallic containers are manufactured without a base coat.

17. A system for decorating a plurality of metallic containers with an image in two distinct printing operations by two independent printers located at two distinct sites, comprising:

a first printer at a first site to print a first portion of the image in a first printing operation by a relief printing process, the first image portion printed in a first section of an exterior surface of each of the plurality of metallic containers, wherein the first printer is operable to print a second section of the exterior surface with a uniform color, the second section distinct from and not overlapping the first section;

a coating device to apply an internal coating to each of the plurality of metallic containers after the first printing operation is completed, wherein the internal coating is dried before a flange is formed on each of the plurality of metallic containers;

an apparatus at the first site to form the flange on an open end of each of the plurality of metallic containers after printing the first image portion in the first printing operation;

a palletizer to place the plurality of flanged and coated metallic containers in a pallet at the first site after printing the first image portion in the first printing operation;

a feeder to remove the plurality of flanged and coated metallic containers from the pallet at a second site, wherein the second site is geographically distinct from the first site;

a mandrel that receives the plurality of flanged and coated metallic containers from the feeder; and a second printer to print a second portion of the image in the second section of the exterior surface of each of the plurality of flanged and coated metallic containers in a second printing operation by a digital printing process, wherein the mandrel orients each of the plurality of flanged and coated metallic containers with respect to the second printer such that the second image portion is registered relative to the first image portion and an outer circumference of the image is formed at least partially by the first section.

18. The system of claim 17, wherein the coating device comprises a spray machine to apply the internal coating to each of the plurality of metallic containers after the first printing operation is completed.

19. The system of claim 17, wherein the second printing operation occurs independently of the first printing operation.

20. A method of decorating a plurality of metallic containers in two distinct operations at two different locations, comprising:

printing, by a first printer at a first site, a first image on a first section of an outer surface of each of the plurality of metallic containers, wherein the first printer is a relief printer;

printing, by the first printer, a second section of the outer surface of each of the plurality of metallic containers with a uniform color, wherein the second section is at least partially adjacent the first section;

spraying a coating onto an inner surface of each of the plurality of the metallic containers after the first printer prints the first and second sections of the plurality of metallic containers;

drying the coating on the plurality of metallic containers;

drawing-in open ends of the each of the plurality of metallic containers to form a flange for an end closure, wherein the flange is formed after the coating is dried;

palletizing the plurality of flanged metallic containers after drawing-in the open ends;

removing a first group of the plurality of flanged metallic containers from a pallet at a second site that is different from the first site;

loading the first group of flanged metallic containers into a second printer at the second site;

detecting a position of each of the first group of flanged metallic containers with respect to the second printer;

orienting each of the first group of flanged metallic containers to align the second section in a predetermined orientation with respect to the second printer; and printing, with the second printer, a second image on the second section of each of the first group of flanged metallic containers, wherein the second printer is a digital printer.

21. The method of claim 20, further comprising:

removing a second group of the plurality of flanged metallic containers from a pallet;

loading the second group of flanged metallic containers into the second printer;

detecting a position of each of the second group of flanged metallic containers with respect to the second printer;

orienting each of the second group of flanged metallic containers to align the second section in a predetermined orientation with respect to the second printer; and printing, with the second printer, a third image on the second section of each of the second group of flanged metallic containers.

22. The method of claim 20, wherein orienting the second section with respect to the second printer comprises a sensor detecting the first image on each of the first group of flanged metallic containers.

* * * * *